US006318971B1

(12) United States Patent
Ota et al.

(10) Patent No.: US 6,318,971 B1
(45) Date of Patent: Nov. 20, 2001

(54) VARIABLE DISPLACEMENT COMPRESSOR

(75) Inventors: Masaki Ota; Muneharu Murase; Tetsuhiko Fukanuma; Katsuya Ohyama, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/524,873

(22) Filed: Mar. 14, 2000

(30) Foreign Application Priority Data

Mar. 18, 1999 (JP) ..... 11-073662

(51) Int. Cl.[7] ..... F04B 1/26
(52) U.S. Cl. ..... 417/222.2
(58) Field of Search ..... 417/222.2, 222.1, 417/269, 218, 219, 270, 213, 199.1, 310

(56) References Cited

U.S. PATENT DOCUMENTS 5,498,140 * 3/1996 Kawaguchi et al. ..... 417/199
5,785,502 * 7/1998 Ota et al. ..... 417/222.2
6,056,513 * 5/2000 Kawaguchi et al. ..... 417/222.1
6,077,047 * 6/2000 Nagai et al. ..... 417/222.2
6,146,107 * 11/2000 Kawaguchi et al. ..... 417/222.2
6,158,970 * 12/2000 Ota et al. ..... 417/222.2

FOREIGN PATENT DOCUMENTS 6-037581 5/1994 (JP) .
10-41219 5/1998 (JP) .
10-153175 6/1998 (JP) .

* cited by examiner

*Primary Examiner*—Teresa Walberg
*Assistant Examiner*—Vinod D. Patel
(74) *Attorney, Agent, or Firm*—Morgan & Finnegan, LLP

(57) ABSTRACT

In a variable displacement compressor that draws, compresses, and discharges refrigerant gas, the displacement is adjusted by varying the inclination of a cam plate in accordance with the difference between the pressure in a crank chamber and the pressure in cylinder bores. A pressurizing passage connects the crank chamber to a discharge passage. A bleed passage connects the crank chamber to a suction chamber. A displacement control valve is externally controlled and varies the pressure in the crank chamber by adjusting the opening size of either the pressurizing passage or the bleed passage. A suction control valve closes a duct between the suction chamber and an evaporator when the pressure in the crank chamber exceeds a predetermined level to prevent an excessively high pressure in the crank chamber.

16 Claims, 6 Drawing Sheets

VARIABLE DISPLACEMENT COMPRESSOR

BACKGROUND OF THE INVENTION

The present invention relates to a variable displacement compressor for air-conditioning vehicles that compresses refrigerant gas and varies the displacement.

FIG. 8 shows an example of the variable displacement compressor (later simply called compressor). A crank chamber 102 is formed in a housing 101, in which a drive shaft 103 is supported. A lip seal 104 is located between the housing 101 and the drive shaft 103.

The drive shaft 103 is connected to a vehicle engine Eg through an electromagnetic clutch 105. The clutch 105 includes a rotor 106 coupled to the engine Eg, an armature 107 fixed to the drive shaft 103, and an electromagnetic coil 108. The coil 108, when excited, causes the armature 107 to be attracted to the rotor 106, which engages the armature 107 with the rotor 106. This transmits power from the engine Eg to the drive shaft 103. At this time, the clutch 105 is engaged. When the coil 108 is de-excited, the armature 107 is separated from the rotor 106, which disconnects power transmission from the engine Eg to the drive shaft 103. At this time, the clutch 105 is disengaged.

A lug plate 109 is fixed to the drive shaft 103 in the crank chamber 102. A swash plate 110 is coupled to the lug plate 109 through a hinge mechanism 111 and integrally rotates with the drive shaft 103. The inclination angle of the swash plate 110 relative to the axis L of the drive shaft 103 is varied. A snap ring 112 is secured to the drive shaft 103 to abut against the swash plate 110 and to limit its minimum inclination angle.

The housing 101 includes cylinder bores 113, a suction chamber 114, and a discharge chamber 115. A piston 116 is accommodated in each cylinder bore 113 to reciprocate. Each piston is coupled to the swash plate 110. A valve plate 117 is located in the housing 101. The valve plate 117 separates the adjacent cylinder bores 113 from the suction chamber 114 and from the discharge chamber 115.

Rotation of the drive shaft 103 is converted into reciprocation of each piston 116 through the lug plate 109, the hinge mechanism 111, and the swash plate 110. This draws refrigerant gas from the suction chamber 114 to the cylinder bores 113 through suction ports 117*a* and suction valves 117*b* of the valve plate 117. Refrigerant gas is compressed in each cylinder bore 113 and discharged to the discharge chamber 115 through discharge ports 117*c* and discharge valves 117*d* of the valve plate 117.

A spring 118 is located between the housing 101 and the drive shaft 103. The spring 118 urges the drive shaft 103 toward the front (left in FIG. 1) of the compressor along the axis L and absorbs dimensional tolerance of parts, which prevents chattering.

A bleed passage 119 connects the crank chamber 102 to the suction chamber 114. A pressurizing passage 120 connects the discharge chamber 115 to the crank chamber 102. A control valve 121 includes a solenoid and varies the opening size of the pressurizing passage 120. The control valve 121 operates depending on the passenger compartment temperature, a target temperature, disengagement of the clutch 105, the state of the engine Eg, and the like.

The control valve 121 varies the size of a valve opening to control the flow rate of gas in the pressurizing passage 120, which supplies high-pressure refrigerant gas to the crank chamber 102. The pressure in the crank chamber is varied by the relationship between the supply of refrigerant gas to the crank chamber 102 and the release of refrigerant gas from the crank chamber 102. This varies the difference between the pressure in the crank chamber 102 and the pressure in the cylinder bores 113, which varies the inclination of the swash plate 110. As a result, the stroke of the pistons 116 is varied, which adjusts the displacement.

When the clutch 105 is disengaged or when the engine Eg stops, the control valve 121 maximizes the size of the valve opening. This increases the pressure in the crank chamber 102 and the difference of the pressure in the crank chamber 102 and the pressures in the cylinder bores 113, which reduces the inclination of the swash plate 110. As a result, inclination of the swash plate 110 is minimized when the compressor is stopped. Therefore, the compressor is restarted with a minimum torque load, and less shock is produced.

However, in this prior art compressor, when the temperature in the passenger compartment is much higher than the target temperature, that is, when the cooling requirement is great, the control valve 121 closes the pressurizing passage 120 and maximizes the compressor displacement.

Suppose that the compressor operated is stopped by the disengagement of the clutch 105 or the shutting off of the engine Eg when operating at maximum development. Also, suppose that a controller minimizes the compressor displacement despite the cooling requirement to reduce the torque load on the engine Eg when the vehicle is suddenly accelerated.

In this case, the closed pressurizing passage 120 is suddenly opened to minimize the displacement. Accordingly, high-pressure refrigerant gas in the discharge chamber 115 is quickly supplied to the crank chamber 102, and the bleed passage 119 does not release the extra gas sufficiently, which increases the pressure in the crank chamber 102 excessively. As a result, the difference between the pressure in the cylinder bores 113 and the pressure in the crank chamber 102 is excessive.

Therefore, the swash plate 110 (shown by the broken line in FIG. 8) is forcefully abutted against the snap ring 112, which strongly draws the lug plate 109 rearward through the hinge mechanism 111. As a result, a strong rearward force is applied to the drive shaft 103, which moves the drive shaft 103 against the force of the spring 118.

When the drive shaft 103 moves rearward, the contact area between the lip seal 104 and the drive shaft 103 may shift. There may be foreign particles like sludge on the surface of the drive shaft 103 at the new contact area. Therefore, the sludge may enter between the lip seal 104 and the drive shaft 103, which degrades the performance of the lip seal 104 and causes gas leakage.

When the compressor is disengaged from the engine Eg and the drive shaft 103 moves rearward, the armature 107, which is fixed to the drive shaft 103, moves toward the rotor 106. The clearance between the rotor 106 and the armature 107 when the clutch 105 is disengaged is very small (0.5 mm, for example). The rearward movement of the drive shaft 103 eliminates the clearance between the rotor 106 and the armature 107, which causes the armature 107 to contact the rotating rotor 106. This causes noise and vibration and transmits power to the compressor.

The rearward movement of the drive shaft 103 during the acceleration of the vehicle moves the pistons 116 and the swash plate 110 rearward, which moves the top dead centers of the pistons 116 rearward. Accordingly, the pistons 116 collide against the valve plate 117 when the pistons 116 reach their top dead center positions. This causes noise, vibration, and damage to the pistons 116 and the valve plate 117.

To prevent the rearward movement of the drive shaft 103, it is possible to increase the force of the spring 118. However, this decreases the life of a thrust bearing 122, which receives the increased force, and increases power losses.

SUMMARY OF THE INVENTION

An objective of the present invention is to provide a variable displacement compressor that prevents sudden increase of the difference between the pressure in the crank chamber and the pressure in the cylinder bores.

To achieve the above objective, the present invention provides a variable displacement compressor that draws, compresses, and discharges refrigerant gas. The compressor is structured as follows. A housing includes a crank chamber, a cylinder bore, a suction chamber, and a discharge chamber. A drive shaft is supported in the housing to pass through the crank chamber. A cam plate is coupled to the drive shaft in the crank chamber. The cam plate changes its inclination and integrally rotates with the drive shaft. A piston is coupled to the cam plate and reciprocates in the cylinder bore. The stroke of the piston is varied by varying the inclination of the cam plate in accordance with the difference between the pressure in the crank chamber and the pressure in the cylinder bore to adjust the displacement of the compressor. A pressurizing passage connects the crank chamber to the discharge chamber. A bleed passage connects the crank chamber to the suction chamber. A displacement control valve is externally controlled and varies the pressure in the crank chamber by adjusting the size of an opening in at least one of the pressurizing passage and the bleed passage. An external refrigerant circuit includes an evaporator and is connected to the suction chamber. A refrigerant duct connects the suction chamber to the evaporator. A suction control valve is located in the refrigerant duct and is externally controlled to open and close the refrigerant duct. The suction control valve closes the duct when the pressure in the crank chamber is above a predetermined level.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor for air-conditioning vehicles according to one embodiment of the present invention will now be described.

Figure 1:
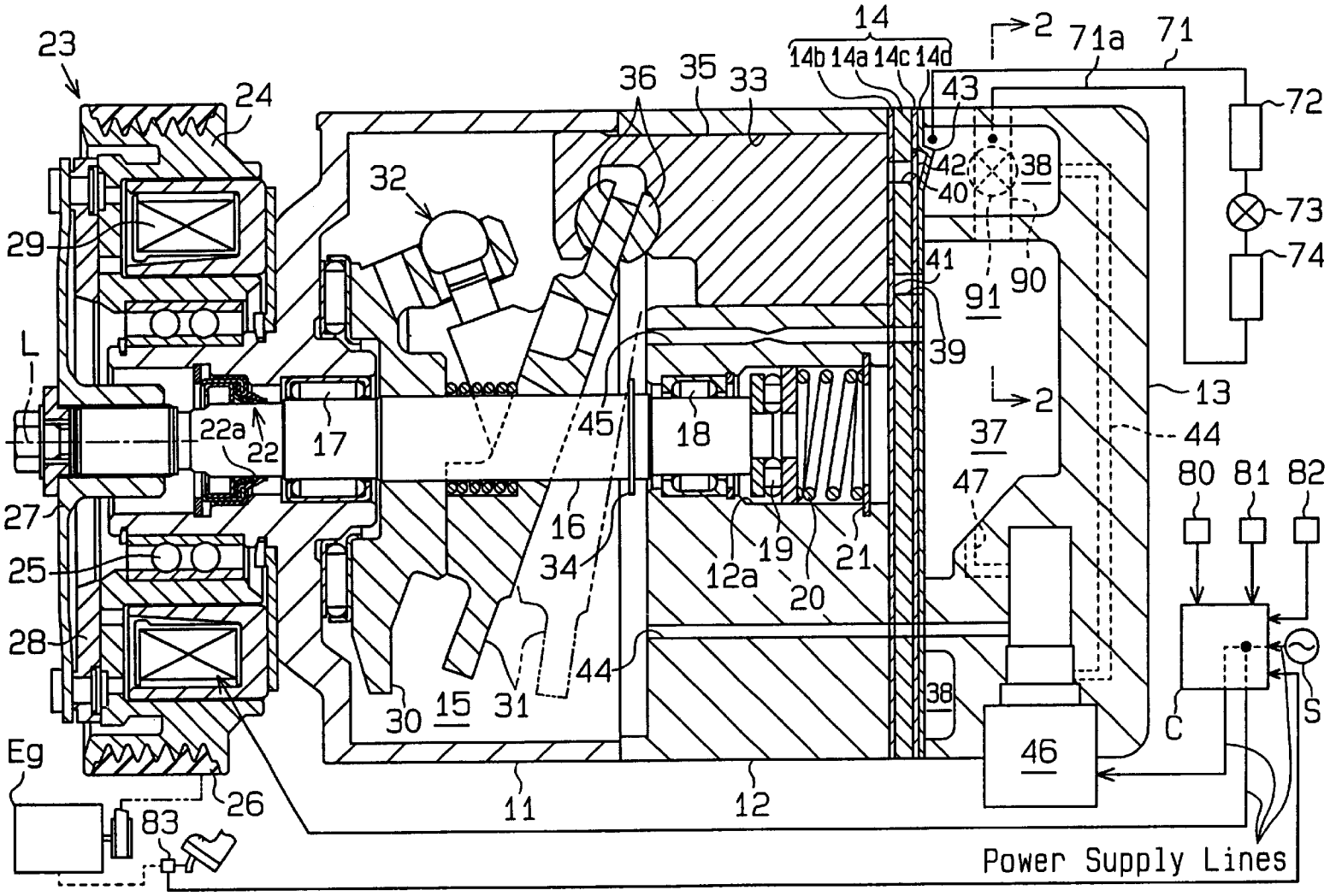
FIG. 1 is a longitudinal cross-sectional view of a variable displacement compressor.

As shown in FIG. 1, a front housing member 11 is coupled to the front of a cylinder block 12, which serves as a center housing member. A rear housing member 13 is coupled the rear of the cylinder block 12 through a valve plate 14. The front housing member 11, the cylinder block 12, and the rear housing member 13 form the compressor housing. The left end of the compressor in FIG. 1 is the front of the compressor, and the right end is the rear.

The valve plate 14 includes first to fourth plates, 14*a,* 14*b,* 14*c,* and 14*d.* The second plate 14*b,* which includes suction valves, is attached to the front surface of the first plate 14*a,* which includes ports. The third plate 14*c,* which includes discharge valves, is attached to the rear surface of the first plate 14*a.* The fourth plate 14*d* is attached to the rear surface of the third plate 14*c.*

A crank chamber 15 is defined by the front housing member 11 and the cylinder block 12. A drive shaft 16 passes through the crank chamber 15 and is supported between the front housing member 11 and the cylinder block 12.

The front end of the drive shaft 16 is supported by the front housing member 11 through a radial bearing 17. A central bore 12*a* is formed at the center of the cylinder block 12. The rear end of the drive shaft 16 is located in the central bore 12*a* and supported by the radial bearing 18. A spring seat 21, which is a snap ring, is fixed to the surface of the central bore 12*a* (inner surface of the cylinder block 12). A thrust bearing 19 and a spring 20 are located between the rear end surface of the drive shaft 16 and the spring seat 21 in the central bore 12*a.* The spring 20, which is a coil spring in this embodiment, urges the drive shaft frontward along the axis L. The thrust bearing 19 prevents the rotational force of the drive shaft 16 from being transmitted to the spring 20.

The front end of the drive shaft 16 passes through and projects from the front wall of the front housing member 11. A lip seal 22, which serves as a shaft seal of the drive shaft 16, is located between the front end of the drive shaft 16 and the front housing member 11. The lip seal 22 includes a lip ring 22*a,* which is pressed against the surface of the drive shaft 16 and seals the drive shaft 16.

An electromagnetic clutch 23 is located between a vehicle engine Eg, or external drive source, and the drive shaft 16. A rotor 24 of the clutch 23 is rotatably supported by the outer wall of the front housing member 11 through an angular bearing 25. The periphery of the rotor 24 receives a belt 26, which is connected to the engine Eg. A hub 27 is fixed to the front end of the drive shaft 16 and the periphery of the hub 27 resiliently supports an armature 28. The armature 28 faces the rotor 24 on the opposite end of the drive shaft 16 from the spring 20. An electromagnetic coil 29 is located in the rotor 24 and supported by the outer wall of the front housing member 11.

Figure 4:
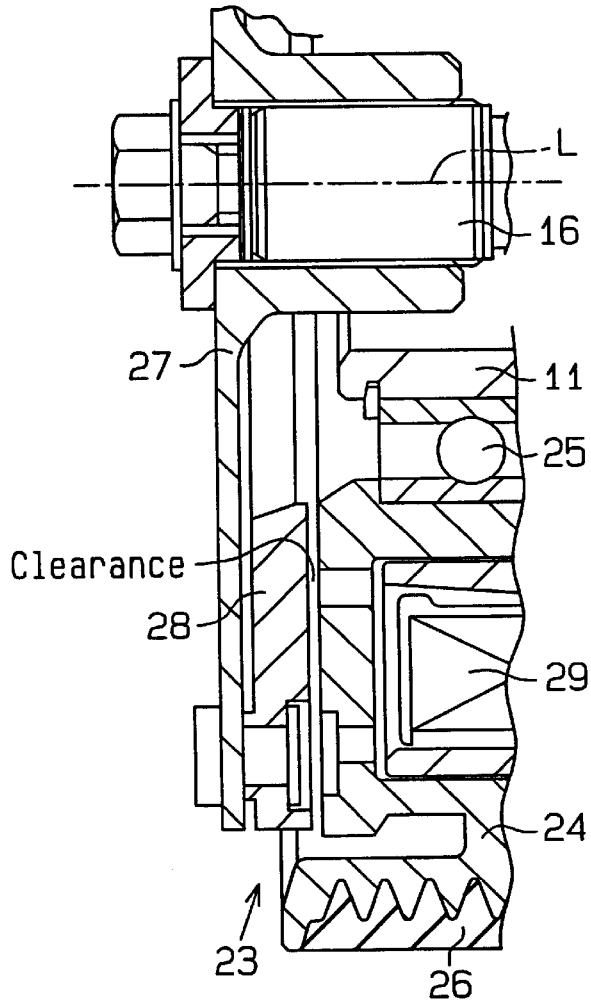
FIG. 4 is a partial cross-sectional view showing disengagement of the clutch.

When the coil 29 is excited while the engine Eg is running, an electromagnetic attraction force is applied between the armature 28 and the rotor 24. Accordingly, the armature 28 contacts the rotor 24 against the elastic force of the hub 27, which engages clutch 23. In this state, power from the engine Eg is transmitted to the drive shaft 16 through the belt 26 and the clutch 23 (See FIG. 1). When the coil 29 is de-excited, the elasticity of the hub 27 separates the armature 28 from the hub 27, which disengages the clutch 23. In this state, power transmission from the engine Eg to the drive shaft 16 is discontinued (See FIG. 4).

A lug plate 30 is fixed to the drive shaft 16 in the crank chamber 15. A swash plate 31, which serves as a cam plate, is supported by the drive shaft 16 and slides on and inclines relative to the drive shaft 16. A hinge mechanism 32 is located between the lug plate 30 and the swash plate 31. The hinge mechanism 32 couples the swash plate 31 to the lug plate 30 and enables the swash plate 31 to rotate integrally with the drive shaft 16 and to vary its inclination relative to the axis L of the drive shaft 16.

A limit stop, or a snap ring 34, is located on the drive shaft 16 between the swash plate 31 and the cylinder block 12. The snap ring 34 is secured on the surface of the drive shaft 16. As shown by the broken line in FIG. 1, the minimum inclination of the swash plate 31 is determined by the abutment of the swash plate 31 against the snap ring 34. As shown in FIG. 1, the maximum inclination of the swash plate 31 is determined by the abutment of the swash plate 31 against the lug plate 30.

Cylinder bores 33 are formed in the cylinder block 12. A single-head piston 35 is accommodated in each cylinder bore 33. Each piston 35 is coupled to the periphery of the swash plate 31 through shoes 36. Rotation of the drive shaft 16 is converted into reciprocation of the pistons 35 in the corresponding cylinder bore 33 through the lug plate 30, the hinge mechanism 32, the swash plate 31, and the shoes 36.

Figure 2:
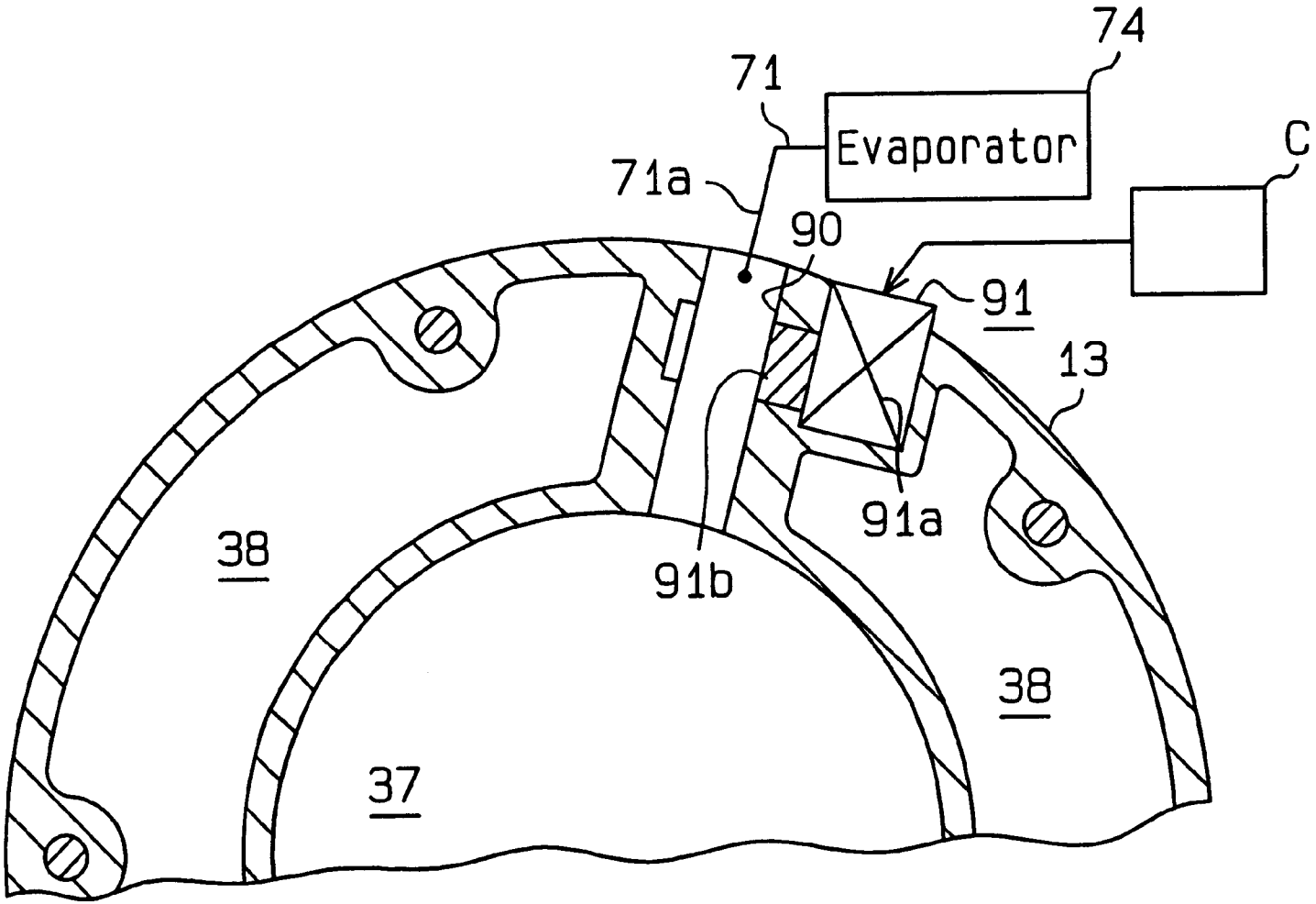
FIG. 2 is a cross-sectional view taken on the line 2—2 of FIG. 1.

As shown in FIGS. 1 and 2, a suction chamber 37, which is a suction pressure zone, is formed in a central region of the rear housing member 13. A discharge chamber 38, which is a discharge pressure zone, is formed in a peripheral region of the rear housing member 13. The suction chamber 37 and the discharge chamber 38 lie on the opposite side of the valve plate 14 from the cylinder bores 33. Suction ports 39 and discharge ports 40 are formed in the first plate 14*a* of the valve plate 14 to correspond to the cylinder bores 33. Suction valves 41 are formed on the second plate 14*b* to correspond to the suction ports 39. Discharge valves 42 are formed on the third plate 14*c* to correspond to the discharge ports 40. Retainers 43 are formed on the fourth plate 14*d* to correspond to the discharge valves 42. The retainers 43 determine the maximum opening size of the discharge valves 42.

The movement of each piston 35 from the top dead center to the bottom dead center draws refrigerant gas to the corresponding cylinder bore 33 through the corresponding suction port 39 and suction valve 41. The movement of each piston 35 from the bottom dead center to the top dead center compresses refrigerant gas in the corresponding cylinder bore 33 to a predetermined pressure and discharges the refrigerant gas to the discharge chamber 38 through the corresponding discharge port 40 and discharge valve 42.

A pressurizing passage 44 connects the discharge chamber 38 to the crank chamber 15. A bleed passage 45 continuously connects the crank chamber 15 to the suction chamber 37. A displacement control valve 46 is located in the pressurizing passage 44. The control valve 46 adjusts the size of the valve opening, which controls the flow in the pressurizing passage 44 and adjusts the supply of high-pressure refrigerant gas to the crank chamber 15. The bleed passage 45 releases refrigerant gas from the crank chamber 15 to the suction chamber 37. The pressure in the crank chamber 15 is varied by the relationship between the rate of inflow and the rate of outflow of refrigerant gas in the crank chamber 15. Accordingly, the difference between the pressure in the crank chamber 15 and the pressure in the cylinder bores 33 is varied, which varies the inclination of the swash plate 31. This varies the stroke of the pistons 35 and the displacement.

The control valve 46 will now be described.

Figure 3:
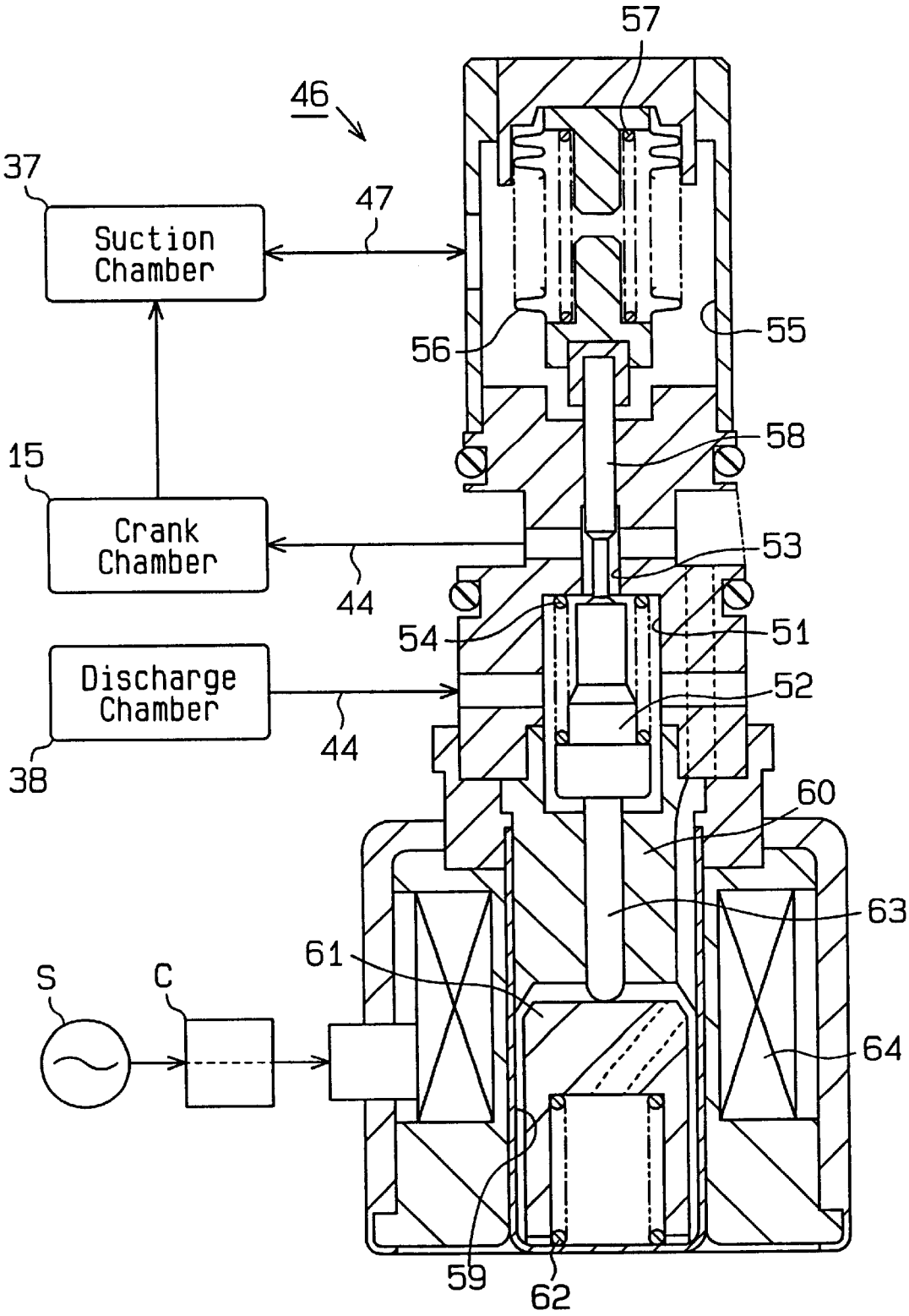
FIG. 3 is a longitudinal cross-sectional view of a control valve.

As shown in FIG. 3, a valve chamber 51 is formed in the pressurizing passage 44. A valve body 52 is accommodated in the valve chamber 51. A valve hole 53 is open to the valve chamber 51 and faces the valve body 52. An opener spring 54 is accommodated in the valve chamber 51 and urges the valve body 52 to open the valve hole 53. The valve chamber 51 and the valve hole 53 form part of the pressurizing passage 44.

A pressure sensitive chamber 55 is adjacent to the valve chamber 51. The pressure sensitive chamber 55 is continuously connected to the suction chamber 37 through a pressure detection passage 47. A bellows 56, which serves as a pressure sensitive member, is accommodated in the pressure sensitive chamber 55. A setting spring 57 is located in the bellows 56. The setting spring 57 determines the initial length of the bellows 56. A pressure sensitive rod 58 is integrally formed with the valve body 52 and couples the bellows 56 to the valve body 52.

A plunger chamber 59 is formed in the opposite end of the control valve 46 to the pressure sensitive chamber 55. A fixed metal core 60 is fitted in the upper part of the plunger chamber 59 and is adjacent to the valve chamber 51. A movable metal core 61 is accommodated in the plunger chamber 59. A follower spring 62 is located in the plunger chamber 59 and urges the movable core 61 toward the valve body 52. A rod 63 is integrally formed with the valve body 52. The forces of the opener spring 54 and the follower spring 62 cause the distal end of the rod 63 to contact the movable core 61. Accordingly, the valve body 52 moves with the movable core 61 through the rod 63. An electromagnetic coil 64 surrounds the fixed core 60 and the movable core 61. The fixed core 60, the movable core 61, the coil 64, and the rod 63 form a main part of the control valve 46, which forms a means for varying a target suction pressure.

As shown in FIG. 1, the suction chamber 37 is connected to the discharge chamber 38 by an external refrigerant circuit 71. The refrigerant circuit 71 includes a condenser 72, an expansion valve 73, and an evaporator 74. The external refrigerant circuit 71 and the compressor form a refrigeration circuit of a vehicle air conditioner.

A computer C is connected to an air-conditioner switch 80, which is a main switch of the air conditioner, a sensor 81 for detecting the temperature in the passenger compartment, and an accelerator sensor 83. The computer C controls the electric power supply from a power source S such as a vehicle battery to the coil 29 of the clutch 23 and the coil 64 of the control valve 46. The computer C controls the power supply from the power source S to each coil 29, 64, based on external signals including ON/Off state of the switch 80, the temperature of the passenger compartment from the sensor 81, a target temperature set by a temperature adjuster 82, and the position of the accelerator from the accelerator sensor 83.

Generally, when the engine Eg is not operating, that is, when the ignition key (not shown) is placed at the accessory-off position, the power supply to the electric devices, which include the air conditioner, is stopped. Accordingly, the power supply lines from the power source S to the coils 29, 64 are disconnected upstream of the computer C, and the power supply from the power source S to each coil 29, 64 is stopped.

Operation of the control valve 46 will now be described.

When the temperature detected by the sensor 81 is higher than the target temperature set by the temperature adjuster 82 while the engine Eg is running and the air-conditioner switch 80 is turned on, the computer C causes electric current to flow from the power source S to the coil 29. This engages the clutch 23 and starts the compressor.

In this state, the bellows 56 of the control valve 46 varies in accordance with the suction pressure in the pressure sensitive chamber 55. The movement of the bellows applies a force to the valve body 52 through the pressure sensitive rod 58 in a direction that either opens or closes the valve hole 53. The computer C determines the level of the electric current supplied to the coil 64 of the control valve 46 based on the temperature in the passenger compartment from the sensor 81 and the target temperature set by the temperature adjuster 82. After determining the level of the current, the computer C instructs that the appropriate current be supplied from the power source S to the coil 64. Exciting the coil 64 generates an electromagnetic attraction force between the fixed core 60 and the movable core 61 in accordance with the level of the current. The attraction force urges the valve body 52 to reduce the opening size of the valve hole 53.

In this way, the opening size of the valve hole 53 is determined by the total of forces including the force applied by the movement of the bellows 56, the attraction force between the fixed core 60 and the movable core 61, the force of each spring 54, 62.

The computer C increases the level of the current supplied to the coil 64 of the control valve 46 as the difference between the temperature in the passenger compartment and the target temperature increases, that is, as the cooling requirement increases. This increases the attraction force between the fixed core 60 and the movable core 61, which reduces the opening size of the valve hole 53. Accordingly, the control valve 46 lowers the target suction pressure and opens and closes the valve hole 53 to maintain the low target suction pressure by the movement of the bellows 56 and the valve body 52. In other words, the control valve 46 adjusts the displacement of the compressor to maintain the low suction pressure by increasing the supply of current to the coil 64.

As the opening size of the valve hole 53 (or pressurizing passage) decreases, the flow rate of refrigerant gas from the discharge chamber 38 to the crank chamber 15 decreases. If the supply of refrigerant gas to the crank chamber 15 is reduced, the pressure in the crank chamber 15 is gradually reduced as refrigerant gas in the crank chamber 15 flows to the suction chamber 37 through the bleed passage 45. Accordingly, the difference between the pressure in the crank chamber 15 and the pressure in the cylinder bore 33 decreases, which increases the inclination of the swash plate 31. This increases the stroke of the pistons 35 and the compressor displacement.

As the difference between the temperature in the passenger compartment and the target temperature decreases, that is, as the cooling requirement decreases, the computer C reduces the level of the current supplied to the coil 64 of the control valve 46. This reduces the attraction between the fixed core 60 and the movable core 61, which reduces the force applied to the valve body 52 and increases the opening size of the valve hole 53. Accordingly, the control valve 46 increases the target suction pressure and maintains the high target suction pressure with the bellows 56, which operates the valve body 52 to open and close the valve hole 53. In other words, the control valve 46 adjusts the compressor displacement to maintain the high suction pressure by reducing the level of the current supplied to the coil 64.

As the opening size of the valve hole 53 (or pressurizing passage 44) increases, the flow rate of refrigerant gas from the discharge chamber 38 to the crank chamber 15 increases. When the flow rate of refrigerant gas to the crank chamber 15 increases, the bleed passage 45 cannot release the increase gas at the same high flow rate. Consequently, the pressure in the crank chamber 15 increases. Accordingly, the difference between the pressure in the crank chamber 15 and the pressure in the cylinder bores 33 increases. This reduces the inclination of the swash plate 31 and the stroke of the pistons 35, which reduces the compressor displacement.

The structure and operation of the present invention will now be described.

Figure 5:
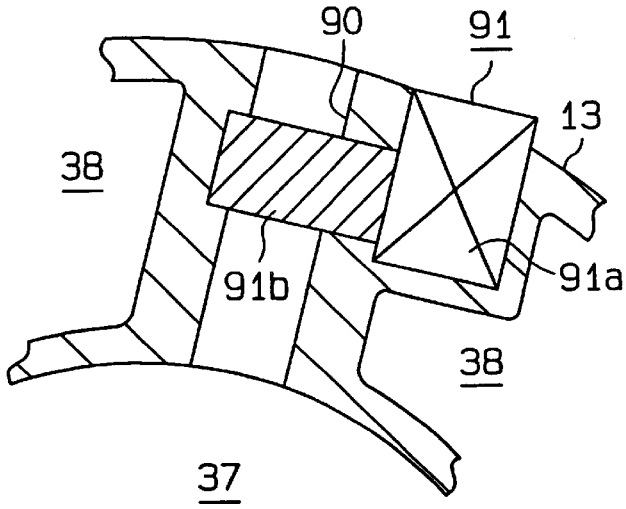
FIG. 5 is a partial cross-sectional view like FIG. 2 showing a limit valve that regulates the suction passage.

As shown in FIGS. 1, 2, and 5, the suction chamber 37 is connected to a duct 71*a*, which is connected to the evaporator 74 of the external refrigerant circuit 71. A suction passage 90 in the rear housing member 13 connects the duct 71*a* to the suction chamber 37. The duct 71*a* and the suction passage 90 form a refrigerant flow passage.

A suction control valve 91, which includes an electromagnetic valve, opens and closes the suction passage 90 in the rear housing member 13. The suction control valve 91 includes a solenoid 91*a* and a valve body 91*b*. The computer C controls the solenoid 91*a*. When the solenoid 91*a* is excited, the valve body 91*b* opens the suction passage 90. When the solenoid 91*a* is de-excited, the valve body closes the suction passage 90.

When the air-conditioner switch 80 is turned off during the operation of the compressor, the computer C stops the supply of current to the coil 29 and disengages the clutch 23, which stops the compressor. Simultaneously, the computer C stops the supply of current to the coil 64 of the displacement control valve 46 and to the solenoid 91*a* of the suction control valve 91.

Figure 6:
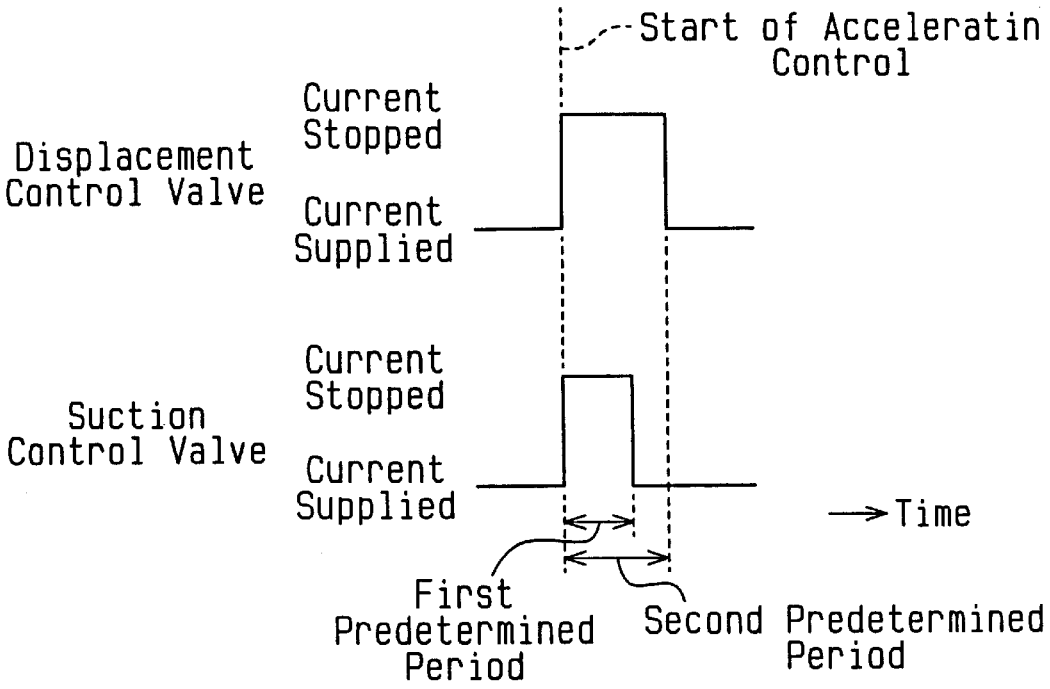
FIG. 6 is a time chart showing the operation of the limit valve.

As shown in the time chart of FIG. 6, when a driver suddenly accelerates the vehicle, and the accelerator sensor 83 detects that the accelerator is open more than a predetermined level, the computer C stops the supply of current to the solenoid 91*a* for a first predetermined period and stops the supply of current to the coil 64 for a second predetermined period. This will be referred to as acceleration control later.

After the lapse of the first period (two seconds, for example), the supply of current to the solenoid 91*a* is restarted, which opens the suction passage 90. After the lapse of the second period (three seconds, for example), that is, after starting the supply of current to the solenoid 91*a*, the supply of current to the coil 64 of the control valve 46 is restarted in accordance with the cooling requirement.

When the engine Eg is stopped during the operation of the compressor, the supply of current from the power source S to the coils 29, 64 and the solenoid 91*a* is disconnected upstream of the computer C.

When the clutch 23 is disengaged or when the supply of current to the coil 64 is stopped, the attraction between the fixed core 60 and the movable core 61 disappears, which maximizes the target suction pressure of the displacement control valve 46. Accordingly, the control valve 46 fully opens the pressurizing passage 44, and the compressor stops at the minimum inclination of the swash plate 31. As a result, the compressor is restarted at the minimum displacement, which minimizes torque load and torque shock.

When the supply of current to the coil 64 is stopped due to the acceleration control, the target suction pressure of the control valve 46 is maximized, which is the same as when the compressor is stopped. Accordingly, the control valve fully opens the pressurizing passage 44 and minimizes the inclination of the swash plate 31. This reduces the compressor displacement and the torque load, which reduces the load on the engine Eg and permits maximum acceleration.

When the compressor is stopped or the acceleration control is performed when the compressor operating at the maximum displacement, the control valve 46 quickly maximizes the opening size of the completely closed pressurizing passage 44. Accordingly, high-pressure refrigerant gas in the discharge chamber 38 suddenly flows to the crank chamber 15, and the bleed passage 45 cannot release the increase of refrigerant gas at the same rate, which suddenly increases the pressure in the crank chamber 15.

However, when the compressor is stopped or when the acceleration control is performed, the computer C stops the supply of current to the solenoid 91*a* of the suction control valve 91, which causes the valve body 91*b* to close the suction passage 90. Accordingly, the suction chamber 37 is disconnected from the evaporator 74, which increases the pressure in the suction chamber 37 due to the supply of refrigerant gas from the crank chamber 15 through the bleed passage 45, which is always open. As a result, the pressure in the cylinder bores 33 is increased because of leakage of high-pressure refrigerant gas from the suction chamber 37 through the sealing parts of the suction valves 41.

Further, the increase of pressure in the suction chamber 37 increases the pressure in the pressure sensitive chamber 55, which is always connected to the suction chamber 37 through the pressure detection passage 47. This makes the pressure in the pressure sensitive chamber 55 higher than the target suction pressure. Accordingly, the displacement control valve 46 reduces the opening size of the fully opened valve hole 53 and the supply of high-pressure refrigerant gas from the discharge chamber 38 to the crank chamber 15. This prevents sudden and extreme increase of pressure in the crank chamber 15.

As described above, an excessive increase of the difference between the pressure in the crank chamber 15 and the pressure in the cylinder bores 33 is prevented, which prevents the swash plate 31 from being strongly pressed against the snap ring 34 and from drawing the lug plate 30 through the hinge mechanism 32. Therefore, the rearward movement of the drive shaft 16 against the force of the spring 20 is prevented.

The illustrated embodiment has the following advantages.

(1) When the pressure in the crank chamber is dramatically increased, such as when the clutch 23 is disengaged, when acceleration control is performed, and when the engine Eg is stopped, the suction control valve 91 closes the suction passage 90. This increases the pressure in the cylinder bores 33 and prevents an extreme increase in the difference between the pressure in the crank chamber 15 and the pressure in the cylinder bores 33. Therefore, the rearward movement of the drive shaft 16 against the force of the spring 20 is limited, which achieves the following advantages.

(1-1) The movement of the drive shaft 16 relative to the lip seal 22 is prevented. This prevents the lip ring 22*a* of the lip seal 22 from shifting to a different contact area. This prevents foreign particles such as sludge from entering between the lip ring 22*a* and the drive shaft 16. Therefore, the life of the lip seal 22 is increased, which prevents gas leakage and extends the life of the compressor.

(1-2) In the clutch 23, the armature 28 moves with respect to the rotor 24 along the axis L, which causes the armature 28 to contact or separate from the rotor 24. If the drive shaft 16 moves rearward when the clutch 23 is disengaged, the predetermined clearance between the rotor 24 and the armature 28 (See FIG. 4) may not be maintained regardless of the attraction force between the rotor 24 and the armature 28. However, the rearward movement of the drive shaft 16 is prevented, which maintains the appropriate clearance between the rotor 24 and the armature 28 and prevents the armature from contacting the rotor 24 when the clutch 23 is disengaged. This ensures disengagement between the rotor 24 and the armature 28 and prevents noise, vibration and heat.

(1-3) The pistons 35 are connected to the drive shaft 16 through the lug plate 30, the hinge mechanism 32, the swash plate 31, and the shoes 36. Accordingly, since the rearward movement of the drive shaft 16 is prevented, the rearward movement of the pistons 35 with the drive shaft 16 is prevented. Accordingly, when each piston 35 is at its top dead center position, the head does not collide with the valve plate 14, which suppresses noise, vibration, and damage to the members 35, 14. This extends the life of the compressor.

(2) The pressure sensitive chamber 55 of the displacement control valve 46 is connected to the suction chamber 37 through the pressure detection passage 47. That is, the bellows 56 operates in accordance with the pressure in the suction pressure zone and is nearer to the suction chamber 37 than the valve body 91*b* of the suction control valve 91. Accordingly, when the pressure in the suction chamber 37 increases while the suction control valve 91 is closed, the displacement control valve 46 reduces the opening size of the valve hole 53 in accordance with the increase of the pressure in the suction chamber 37. This prevents a sudden increase of the pressure in the crank chamber 15. Therefore, a sudden increase in the difference between the pressure in the crank chamber 15 and the pressure in the cylinder bores 33 is more effectively prevented.

(3) The displacement control valve 46 adjusts the flow rate of high-pressure refrigerant gas to the crank chamber 15 by opening and closing the pressurizing passage 44, which adjusts the compressor displacement. The control valve 46 of this compressor can increase the pressure in the crank chamber 15 more quickly than a control valve that adjusts the displacement by opening and closing the bleed passage 45. Accordingly, the displacement is quickly minimized when the compressor is stopped, and the compressor is restarted at the minimum displacement immediately after the previous stop. In other words, the suction control valve 91 is more effective in a compressor that tends to cause an extreme increase of the pressure in the crank chamber 15, compared to a compressor in which the displacement control valve 46 adjusts the opening size of the bleed passage 45.

(4) When the acceleration control is stopped, the supply of current to the coil 64 of the displacement control valve 46 is restarted in accordance with the cooling requirement soon after the supply of current to the solenoid 91*a* of the suction control valve 91 is restarted. In this way, when the control valve 46 starts responding to the cooling requirement, the refrigeration cycle is quickly restarted by promptly opening the suction control valve 91, which opens the refrigeration circuit. This enables the air conditioner to quickly respond to the cooling requirement.

(5) For example, the electromagnetic structure of the control valve 46 may be changed such that the attraction force applied between the fixed core 60 and the movable core 61 urges the valve body 52 to increase the opening size of the valve hole 53. That is, as the supply of current to the coil 64 increases, the target suction pressure may be increased. In this case, to minimize the displacement when the engine Eg is not operating, in other words, to maximize the target suction pressure, the supply of current line from the power source S to the coil 64 must not be disconnected downstream of the computer C. This requires a significant change to the existing current supply systems for vehicles.

However, the control valve 46 of the present embodiment increases the target suction pressure as the supply of current to the coil 64 decreases. When the target suction pressure is maximized, the computer C stops the supply of current to the coil 64. The result is the same when the supply line from the power source S to the coil 64 is disconnected upstream of the computer C when the engine Eg is not operating. Therefore, the minimization of the displacement when the engine Eg is not operating is achieved without significantly changing the structure of existing vehicle electrical systems for vehicles.

The present invention can further be embodied as follows.

Figure 7:
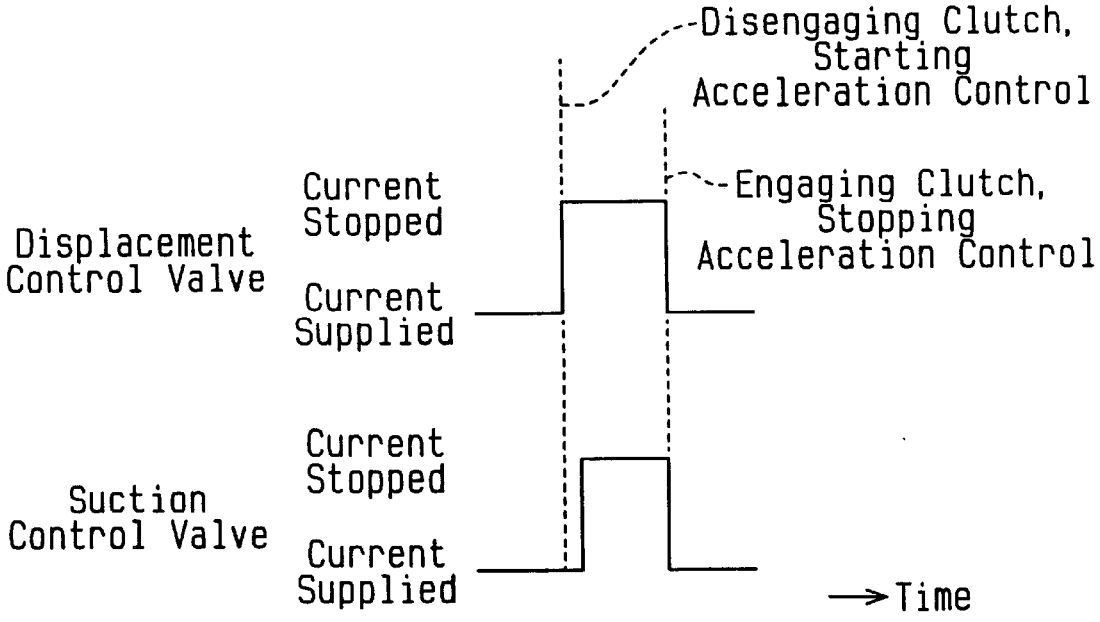
FIG. 7 is a time chart showing another example.

As shown by the time chart in FIG. 7, the program of the computer C may be changed such that the supply of current to the solenoid 91a of the suction control valve 91 is stopped to close the suction passage 90 slightly after (one second, for example) after the supply of current to the coil 64 of the displacement control valve 46 is stopped when the clutch 23 is disengaged or when the acceleration control is performed. In this case, the extreme increase of the difference between the pressure in the crank chamber 15 and the pressure in the cylinder bores 33 is prevented, and the displacement is minimized by increasing the pressure difference up to a predetermined difference.

When acceleration control is performed, the supply of current to the solenoid 91*a* and the supply of current to the coil 64 may be restarted based on an acceleration stop signal from the accelerator sensor 83 (when the opening of the accelerator is below a predetermined level) instead of restarting them after the lapses of the predetermined periods from the start of the acceleration control.

The supply of current to the solenoid 91*a* and the supply of current to the control valve 46 may be simultaneously restarted (See FIG. 7).

The suction control valve 91 may close the suction passage 90 only when the disengagement of the clutch 23 or the acceleration control is performed with the minimum target suction pressure of the displacement control valve 46.

The criteria for executing acceleration control may include that the engine speed exceeds a predetermined level in addition to the opening of accelerator being above the predetermined level.

In addition to acceleration control, there are cases in which the control valve 46 minimizes the displacement regardless of the cooling requirement. For example, when the detected temperature of the evaporator 74 is below a predetermined level, the evaporator 74 is likely to be frosted. Therefore, the displacement may be minimized when the frosting temperature is sensed.

Figure 8:
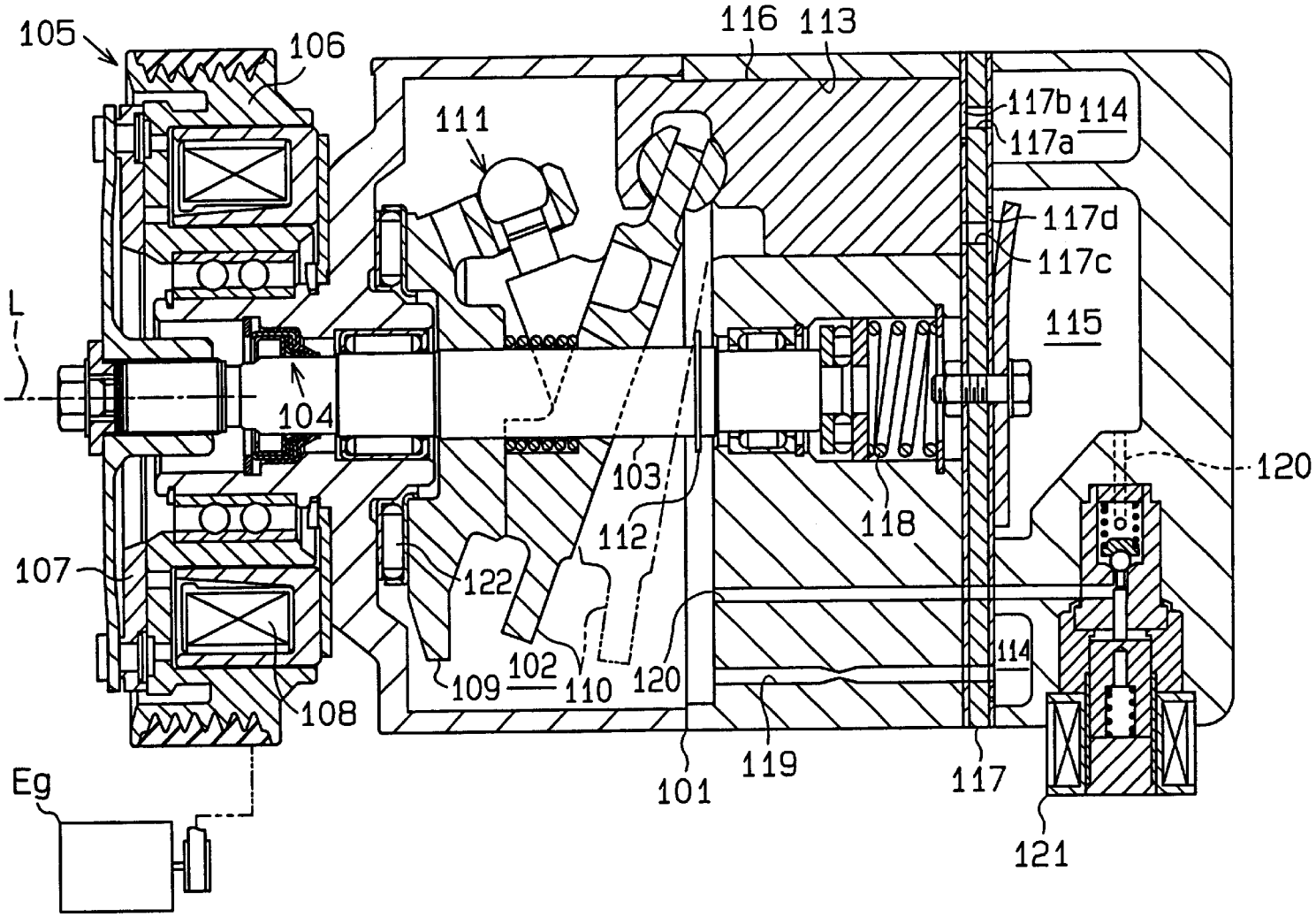
Fig.8(Prior Art)
FIG. 8 is a longitudinal cross-sectional view of a prior art variable displacement compressor.

In the above embodiments, the valve body 52 is operated to open and close the pressurizing passage 44 by the cooperation of the pressure sensitive mechanism (56, 58) and the electromagnetic mechanism (60, 61, 63, 64). This may be changed such that only the electromagnetic mechanism operates the valve body 52 to adjust the pressurizing passage 44, as in the prior art of FIG. 8.

Both the pressurizing passage 44 and the bleed passage 45 may be opened and closed by the control valve 46 to adjust the displacement. In this case, it is important not to completely close the bleed passage 45. That is, the bleed passage should always be connected to the suction passage 90.

The control valve 46 may open and close only the bleed passage 45 to adjust the displacement. In this case, also, the bleed passage should always be connected to the suction passage 37.

The present invention may be embodied in wobble-type variable displacement compressors.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor that draws, compresses, and discharges refrigerant gas, the compressor comprising:

a housing, which includes a crank chamber, a cylinder bore, a suction chamber, and a discharge chamber;

a drive shaft, which is supported in the housing to pass through the crank chamber;

a cam plate, which is coupled to the drive shaft in the crank chamber, wherein the cam plate changes its inclination and integrally rotates with the drive shaft;

a piston, which is coupled to the cam plate and reciprocates in the cylinder bore, wherein the stroke of the piston is varied by varying the inclination of the cam plate in accordance with the difference between the pressure in the crank chamber and the pressure in the cylinder bore to adjust the displacement of the compressor;

a pressurizing passage, which connects the crank chamber to the discharge chamber;

a bleed passage, which connects the crank chamber to the suction chamber;

a displacement control valve, which is externally controlled and varies the pressure in the crank chamber by adjusting the size of an opening in at least one of the pressurizing passage and the bleed passage;

an external refrigerant circuit, which includes an evaporator and is connected to the suction chamber;

a refrigerant duct, which connects the suction chamber to the evaporator; and a suction control valve, which is located in the refrigerant duct and is externally controlled to open and close the refrigerant duct, wherein the suction control valve closes the duct when the pressure in the crank chamber is above a predetermined level.

2. The variable displacement compressor according to claim 1 further including:

a valve body, which opens and closes at least one of the pressurizing passage and the bleed passage;

a pressure sensitive member, which is coupled to the valve body and is located between the suction control valve and the suction chamber, wherein the pressure sensitive member operates the valve body in accordance with the pressure in the suction chamber; and a means for varying a target suction pressure by an external control, wherein the operation of the pressure sensitive member is based on the target suction pressure.

3. The variable displacement compressor according to claim 1, wherein the displacement control valve adjusts the opening size of the pressurizing passage.

4. The variable displacement compressor according to claim 1 further including:

an external drive source, which rotates the drive shaft; and an electromagnetic clutch, which is located between the external drive source and the drive shaft, wherein the clutch connects and disconnects the compressor and the drive source, the clutch including:

a rotor, which is supported in the housing and coupled to the external drive source;

an armature, which is fixed to the drive shaft, wherein the armature faces the rotor; and an electromagnetic coil, wherein exciting the coil causes the armature to engage the rotor, which causes power to be transmitted between the armature and the rotor.

5. The variable displacement compressor according to claim 1, wherein the displacement control valve adjusts the flow rate of gas in at least one of the pressurizing passage and the bleed passage to minimize the displacement when the rotation of the drive shaft is stopped, and wherein the suction control valve closes the refrigerant duct when the rotation of the drive shaft is stopped.

6. The variable displacement compressor according to claim 1, wherein, at certain times, the displacement control valve adjusts the size of the opening to minimize the displacement regardless of the cooling requirement during the rotation of the drive shaft, and wherein the suction control valve closes the refrigerant duct at the certain times.

7. The variable displacement compressor according to claim 5, wherein, after the displacement control valve operates to minimize the displacement, the suction control valve closes the refrigerant duct after a lapse of predetermined period.

8. The variable displacement compressor according to claim 6, wherein the suction control valve opens the refrigerant duct before the displacement control valve adjusts the size of the opening in response to the cooling requirement.

9. A variable displacement compressor that draws, compresses, and discharges refrigerant gas, the compressor comprising:

a housing, which includes a crank chamber, a cylinder bore, a suction chamber, and a discharge chamber;

a drive shaft, which is supported in the housing to pass through the crank chamber;

a cam plate, which is coupled to the drive shaft in the crank chamber, wherein the cam plate changes its inclination and integrally rotates with the drive shaft;

a piston, which is coupled to the cam plate and reciprocates in the cylinder bore;

a valve plate, which is located in the housing and separates the cylinder bore from the adjacent suction chamber, the valve plate including a suction port, a suction valve, a discharge port, and a discharge valve;

an urging member, which is located between the housing and the drive shaft, wherein the urging member urges the drive shaft axially to separate the piston from the valve plate;

a pressurizing passage, which connects the crank chamber to the discharge chamber;

a bleed passage, which connects the crank chamber to the suction chamber;

a displacement control valve, which is externally controlled and varies the pressure in the crank chamber by adjusting the size of an opening in at least one of the pressurizing passage and the bleed passage;

wherein varying the inclination of the cam plate adjusts the displacement in accordance with the difference between the pressure in the crank chamber and the pressure in the cylinder bore;

an external refrigerant circuit, which includes an evaporator and is connected to the suction chamber;

a refrigerant duct, which connects the suction chamber to the evaporator; and a suction control valve, which is located in the refrigerant duct and is externally controlled to open and close the refrigerant duct, wherein the suction control valve closes the duct when the pressure in the crank chamber is above a predetermined level.

10. The variable displacement compressor according to claim 9 further including:

a valve body, which opens and closes at least one of the pressurizing passage and the bleed passage;

a pressure sensitive member, which is coupled to the valve body and is located between the suction control valve and the suction chamber, wherein the pressure sensitive member operates the valve body in accordance with the pressure in the suction chamber; and a means for varying a target suction pressure through external control, wherein the operation of the pressure sensitive member is based on the target suction pressure.

11. The variable displacement compressor according to claim 9, wherein the displacement control valve adjusts the size of an opening in the pressurizing passage.

12. The variable displacement compressor according to claim 9 further including:

an external drive source, which rotates the drive shaft; and an electromagnetic clutch, which is located between the external drive source and the drive shaft, wherein the clutch connects and disconnects the compressor and the drive source, the clutch including:

a rotor, which is supported in the housing and coupled to the external drive source;

an armature, which is fixed the drive shaft, wherein the armature faces the rotor; and an electromagnetic coil, wherein exciting the coil causes the armature to engage the rotor, which causes power to be transmitted between the armature and the rotor.

13. The variable displacement compressor according to claim 9, wherein the displacement control valve adjusts the flow rate of gas in at least one of the pressurizing passage and the bleed passage to minimize the displacement when the rotation of the drive shaft is stopped, and wherein the suction control valve closes the refrigerant duct when the rotation of the drive shaft is stopped.

14. The variable displacement compressor according to claim 13, wherein, after the displacement control valve operates to minimize the displacement, the suction control valve closes the refrigerant duct after a lapse of predetermined period.

15. The variable displacement compressor according to claim 9, wherein, at certain times, the displacement control valve adjusts the size the opening to minimize the displacement regardless of the cooling requirement during the rotation of the drive shaft, and wherein the suction control valve closes the refrigerant duct at the certain times.

16. The variable displacement compressor according to claim 14, wherein the suction control valve opens the refrigerant duct before the displacement control valve adjusts the size of the opening in response to the cooling requirement.

* * * * *

UNITED STATES PATENT AND TRADEMARK OFFICE

CERTIFICATE OF CORRECTION

PATENT NO. : 6,318,971 B1
DATED : November 20, 2001
INVENTOR(S) : Masaki Ota et al.

It is certified that error appears in the above-identified patent and that said Letters Patent is hereby corrected as shown below:

Title page,
Item [56], References Cited, please add -- U.S. PATENT DOCUMENTS
5,173,032 12/1992 Taguchi et al.

FOREIGN PATENT DOCUMENTS
EP 0 845 593 A1 6/1998 (EP)
EP 0 707 182 A2 4/1997 (EP) --

Signed and Sealed this

Sixth Day of August, 2002

*Attest:*

*Attesting Officer*

JAMES E. ROGAN
*Director of the United States Patent and Trademark Office*